US005931242A

United States Patent [19]

Oettli

[11] Patent Number: 5,931,242

[45] Date of Patent: Aug. 3, 1999

[54] JARRING TOOL ENHANCER

[75] Inventor: Mark C. Oettli, Erie, Pa.

[73] Assignee: IRI International Corporation, Houston, Tex.

[21] Appl. No.: 08/827,831

[22] Filed: Apr. 11, 1997

[51] Int. Cl.[6] ..... E21B 31/113

[52] U.S. Cl. ..... 175/296; 166/178; 175/321

[58] Field of Search ..... 175/296, 321; 166/178

[56] References Cited

U.S. PATENT DOCUMENTS

| | | | |
|---|---|---|---|
| 2,819,876 | 1/1958 | Ransom | 255/27 |
| 3,063,501 | 11/1962 | Britton | 166/178 |
| 3,239,017 | 3/1966 | Hazen et al. | 175/296 |
| 3,285,353 | 11/1966 | Young | 175/297 |
| 3,392,795 | 7/1968 | Greer | 175/297 |
| 3,570,612 | 3/1971 | Slator | 175/297 |
| 3,606,297 | 9/1971 | Webb | 267/125 |
| 3,735,827 | 5/1973 | Berryman | 175/296 |
| 3,735,828 | 5/1973 | Berryman | 175/299 |
| 3,797,591 | 3/1974 | Berryman | 175/296 |
| 3,804,185 | 4/1974 | Mason | 175/297 |
| 3,851,717 | 12/1974 | Berryman | 175/297 |
| 3,898,815 | 8/1975 | Young | 64/23.7 |
| 3,949,821 | 4/1976 | Raugust | 175/297 |
| 3,955,634 | 5/1976 | Slator et al. | 175/297 |
| 3,987,858 | 10/1976 | Slator et al. | 175/297 |
| 4,023,630 | 5/1977 | Perkin et al. | 175/297 |
| 4,161,224 | 7/1979 | Hostrup | 175/297 |
| 4,186,807 | 2/1980 | Sutliff et al. | 175/302 |
| 4,196,782 | 4/1980 | Blanton | 175/297 |
| 4,200,158 | 4/1980 | Perkins | 175/297 |
| 4,210,214 | 7/1980 | Blanton | 175/297 |
| 4,331,006 | 5/1982 | Bishop | 464/18 |
| 4,439,167 | 3/1984 | Bishop et al. | 464/20 |
| 4,511,007 | 4/1985 | Jung et al. | 175/297 |
| 4,566,546 | 1/1986 | Evans | 175/297 |
| 4,658,917 | 4/1987 | Ring | 175/297 |
| 4,662,460 | 5/1987 | Loeb et al. | 175/305 |
| 4,844,183 | 7/1989 | Evans | 175/296 |
| 4,846,273 | 7/1989 | Anderson et al. | 166/178 |
| 4,865,125 | 9/1989 | Cuir | 166/178 |
| 5,007,479 | 4/1991 | Pleasants et al. | 166/178 |
| 5,033,557 | 7/1991 | Askew | 175/297 |
| 5,066,060 | 11/1991 | Cooksey et al. | 294/86.18 |
| 5,069,282 | 12/1991 | Taylor | 166/301 |
| 5,086,853 | 2/1992 | Evans | 175/297 |
| 5,232,060 | 8/1993 | Evans | 175/297 |
| 5,425,430 | 6/1995 | Roberts | 175/296 |
| 5,431,221 | 7/1995 | Roberts et al. | 166/73 |
| 5,447,196 | 9/1995 | Roberts | 166/178 |
| 5,584,353 | 12/1996 | Chancey et al. | 175/297 |

OTHER PUBLICATIONS

"Instruction Manual Bowen Jar Intensifiers, " Manual No. 5/4019, Bowen Tools, Inc., Jul. 1984.

"Bumper sub, jar accelerator, combination drilling jar, " DES/ Griffith, *Classified Index of Products & Services in the 37th (1986–87) Revision of Composite Catalog*, p. 1693.

"H–E Accelerator,"Houston Engineers, Inc, *Classified Index of Products & services in the 37th (1986–87) Revision of Composite Catalog*, pp. 2704–2705.

*Primary Examiner*—Hoang C. Dang

*Attorney, Agent, or Firm*—Pravel, Hewitt and Kimball

[57] ABSTRACT

A dual acting hydraulic jarring enhancer which is particularly well suited for coiled tubing application. A common annular chamber is formed between reciprocating cylindrical assemblies, and a piston is positioned within the annular chamber. The inner cylindrical assembly has a member to contact the piston and move it relative to the outer cylindrical assembly in one direction while the outer cylindrical assembly has a member to prohibit longitudinal movement of the piston relative to the inner cylindrical assembly in a second direction. In this manner, the present invention provides a tool with overall minimal length by using a singular annular chamber capable of being divided into two other chambers and providing an accelerating effect to a hammer/anvil of an associated jarring tool in either an upjarring or downjarring mode.

8 Claims, 5 Drawing Sheets

JARRING TOOL ENHANCER

BACKGROUND OF THE INVENTION

1. Field of the Invention

The present invention relates to a downhole tool for enhancing the force of a downhole jarring tool. More particularly, the present invention relates to a downhole tool capable of enhancing an upward jarring blow or a downward jarring blow emanated from a double acting hydraulic well jar useful in coiled tubing and conventional drilling applications.

2. Description of the Related Art

Jarring tools are used to free stuck drill pipe or well tools in a well bore. They provide a substantial upward or downward jarring action in an effort to transmit sufficient force to dislodge a stuck member. Double acting jars which can transmit either upward or downward jarring loads are well known in the prior art. See, for example, U.S. Pat. Nos. 4,186,807; 4,865,125; and 5,007,479. Such jars typically use a hydraulic-type fluid to isolate well bore pressure and provide the working fluid through which the jarring tool operates.

It may also be helpful to employ a downhole tool proximate the jarring tool which serves to enhance or accentuate the force exerted by the jarring tool on the stuck tool in either the upward jarring mode or the downward jarring mode. Typically, such tools serve to accelerate the rate at which the hammer of a jarring tool strikes the anvil or other portion which generates the jarring action. Examples of enhancers or accelerators are set forth in U.S. Pat. Nos. 3,735,828; 4,846,237; 5,232,060; 5,425,430; and 5,584,353.

With the advent of coiled tubing techniques, the need exists for a variety of downhole tools capable of performing their traditional functions but in the confines of a coiled tubing application. Briefly, a coiled tubing operation involves the use of a single continuous pipe or tubing for drilling or workover applications rather than the more traditional 30-foot drill pipe sections. The tubing, which is coiled onto a reel and uncoiled as it is lowered into the well bore, can be used for either drilling or workover applications. However, coiled tubing presents a number of working constraints to existing tool design. First, due to the size of the coiled tubing, limited compressive and tensile loads can be placed on the tubing by the rig operator. Essentially, this means that downhole tools which require tensile or compressive force to operate, such as a jarring tool, must be capable of operating with the limited compressive load capability of coiled tubing. In addition, in coiled tubing application the overall length of the downhole tool becomes significant since there is limited distance available between the stuffing box and the blowout preventor to accommodate the bottom hole assembly. A typical bottom hole assembly includes a quick disconnect, an enhancer or accelerating tool, a sinker bar located below the enhancer to provide weight to the bottom hole assembly, the jarring tool, a release tool below that of some type, and then an overshot. There may be other tools as well which may be needed. Thus, the length of the jarring tool enhancer becomes particularly significant since the entire bottom hole assembly must fit within the limited distance between the riser and blowout preventor to introduce it into a pressurized well. Furthermore, within these confines, the jarring tool enhancer must have a large enough internal bore to permit pump-down tools to pass. Thus, the coiled tubing jarring tool enhancer must have a limited overall wall thickness in view of limited outer diameter conditions, and must be of limited length.

As in the case of traditional drill pipe, coiled tubing or other down hole tools may get stuck in the well bore at times. Under these circumstances, the ability to generate an enhanced load through a mechanism which accelerates the jarring motion of the jarring tool and introduces an auxiliary force is particularly advantageous. Thus, the need exists for a jarring tool enhancer which can satisfy the limited load, limited length, and large bore requirements of coiled tubing application as mentioned above. Preferably, such a jarring tool enhancer would have application in a conventional drill string as well.

SUMMARY OF THE INVENTION

Briefly, the present invention is a well jar enhancer having inner and outer overlapping, telescopingly related cylindrical assemblies or tubular members which move longitudinally relative to one another. Because of their overlapping nature, an annular space or chamber is formed between the inner and outer cylindrical assemblies. Longitudinal splines are provided on both cylindrical assemblies which are slidably engaged in an interlocking fit to permit relative longitudinal movement yet prevent relative rotational movement. Upper and lower annular seals are preferably provided which seal off the annular space from the well bore. A sealing piston is positioned within the annular space and adapted for longitudinal displacement therein. The inner assembly includes a member which contacts the piston as the inner assembly moves relative to the outer assembly in a first direction thereby defining a first chamber between the first sealing means and the piston and a second chamber between the second sealing means and the piston. The outer assembly includes a member to prohibit longitudinal movement of the piston within the annular space beyond a predetermined point when the inner assembly moves relative to the outer assembly in a second direction, thereby defining another first chamber between the first sealing means and the piston and another second chamber between the second sealing means and the piston.

The present invention permits telescopic movement of the inner cylindrical assembly relative to the outer cylindrical assembly in either the first or second direction wherein displacement of the piston relative to the outer assembly in the first direction and displacement of the piston relative to the inner cylindrical assembly in said second direction creates a pressure differential between the first and second chambers permitting acceleration of the outer cylindrical assembly relative to the inner cylindrical assembly to balance the pressures in the said first and second chambers at a predetermined time for each said first and second directions.

The inner and outer cylindrical assembly of the present invention are each comprised of multiple tubular elements which, in the event of separation between adjacent tubular elements due to pressure build up or loads for example, will interlock to avoid separation of the drill string or coiled tubing.

While the present invention has been described in terms of a coiled tubing application principally, it should be understood that the elements of the present invention have equal application as a jarring tool enhancer for use with a jarring tool to free stuck conventional drill strings and downhole tools.

Examples of the more important features of this invention have been summarized rather broadly in order that the detailed description may be better understood. There are, of course, additional features of the invention which will be described hereinafter and which will also form the subject of the claims appended hereto.

DETAILED DESCRIPTION OF THE PREFERRED EMBODIMENT

Figure 1A:
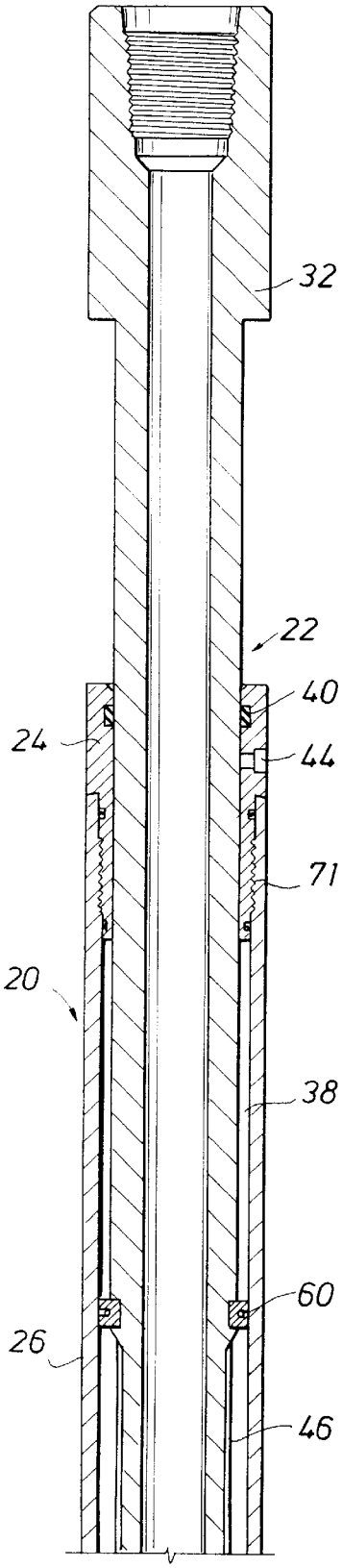
FIGS. 1A–1C are detailed fragmented vertical cross-sectional views of the present invention in a neutral position.
Figure 1B:
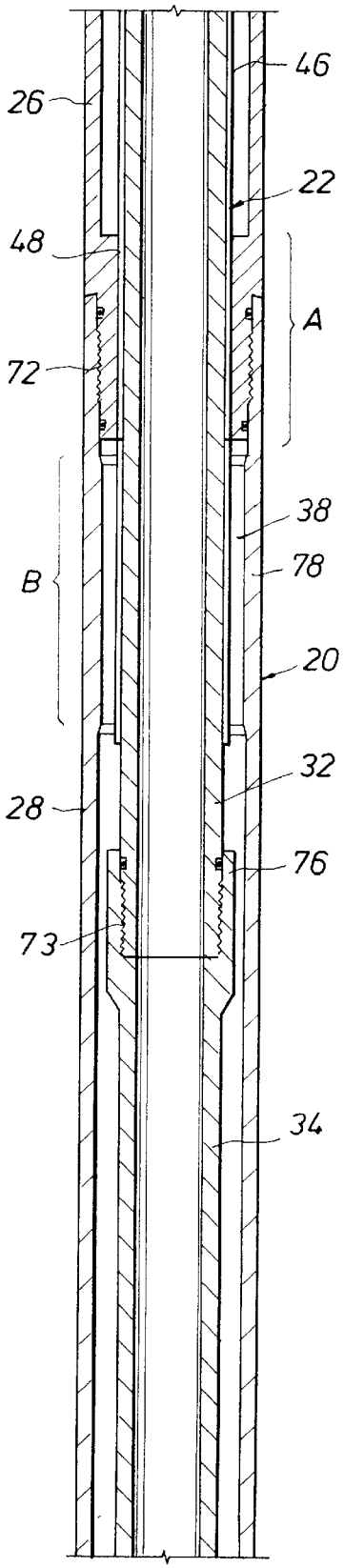
Figure 1C:
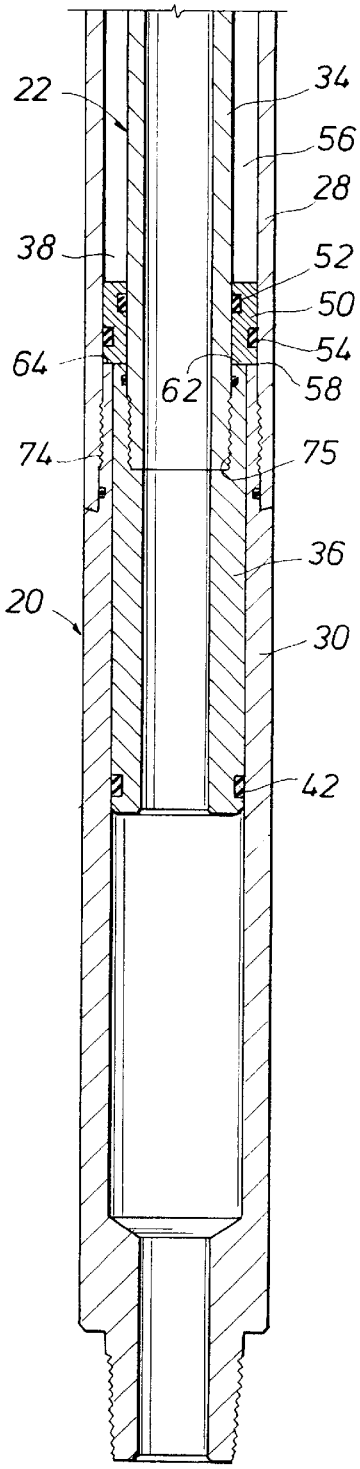

Referring to FIGS. 1A–1C, the present invention comprises an outer cylindrical assembly or tubular member 20 and an inner cylindrical assembly or tubular member 22. Typically, outer cylindrical assembly or tubular member 20 comprises a mandrel body 24 threadably connected to a spline body 26. Spline body 26 is in turn threadably connected to middle body 28 which is threadably connected to washpipe body 30. Typically, inner cylindrical assembly or tubular member 22 comprises a mandrel 32 threadably connected to mandrel extension 34. Mandrel extension 34 is in turn threadably connected to washpipe 36. Threaded connections 71, 72, 73, 74 and 75 typically include one or two o-rings within each connection to create a sealed connection across the threads thereby preventing pressure loss.

Referring still to FIGS. 1A–1C, inner cylindrical assembly 22 is positioned within outer cylindrical assembly 20 in a telescoping fashion defining an annular space 38 which is sealed at the top or upper end thereof by a seal 40 and at the bottom or lower end thereof by a seal 42. In this manner, any hydraulic fluid or other medium within chamber 38 is isolated from the effects of hydrostatic pressure or well bore pressure. Chamber 38 may be filled with hydraulic fluid through fill outlet 44. A threadable plug (not shown) would be inserted within fill 44 to seal off chamber 38. The type of hydraulic fluid or other fluid which could be used in annular chamber 38 is well known to those skilled in the art and may be, for example, a hydraulic fluid, preferably a synthetic silicone liquid which is slightly more compressive than standard hydraulic oil. Preferably, the synthetic silicone liquid is in the range of approximately 8% to 12% compressible.

Referring to FIGS. 1A and 1B, mandrel 32 includes circumferentially spaced splines 46. Similarly, spline body 26 includes similarly circumferentially spaced splines 48 within region "A" of spline body 26. Splines 48 of spline body 26 interlock in a meshing manner with splines 46 of mandrel 32. In this manner, longitudinal movement of outer cylindrical assembly 20 relative to inner cylindrical assembly 22 is permitted but relative rotational movement between outer cylindrical assembly 20 and inner cylindrical assembly 22 is prohibited. Thus, any torquing, or motor drilling or rotary drilling activity may continue to occur through the jarring tool enhancer.

Referring now to FIG. 1C, the present invention also includes a piston 50 which is longitudinally positioned within annular chamber 38. Piston 50 includes an internal seal member 52 which seals against the outer surface of mandrel extension 34. Similarly, piston 50 includes an outer seal 54 which seals against the inner surface of middle body 28. In this manner, it will be apparent to one skilled in the art that piston 50 is capable of dividing chamber 38 into two distinct pressure chambers. The first chamber 56 would extend between top or upper seal 40 to piston 50 while a second chamber 58 would extend from bottom or lower seal 42 to piston 50. Referring briefly to FIG. 1A, a mandrel retainer ring 60 is positioned circumferentially around mandrel 32 to help centralize mandrel 32 within outer cylindrical assembly 20, and in particular blind body 26. Mandrel retainer 60 is not a seal; rather, it serves primarily to retain mandrel 32 within outer cylindrical assembly 20. Thus, fluid may pass easily through mandrel retainer 60 permitting chamber 56 to extend from top seal 40 to piston 50.

Figure 2A:
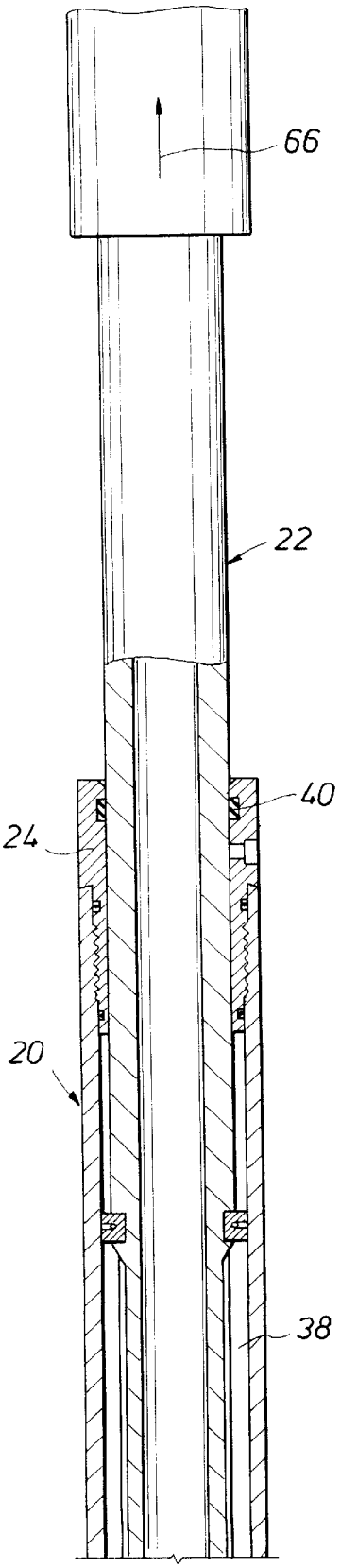
FIGS. 2A–2C are detailed fragmented vertical cross-sectional views of the present invention in a partially open position.
Figure 2B:
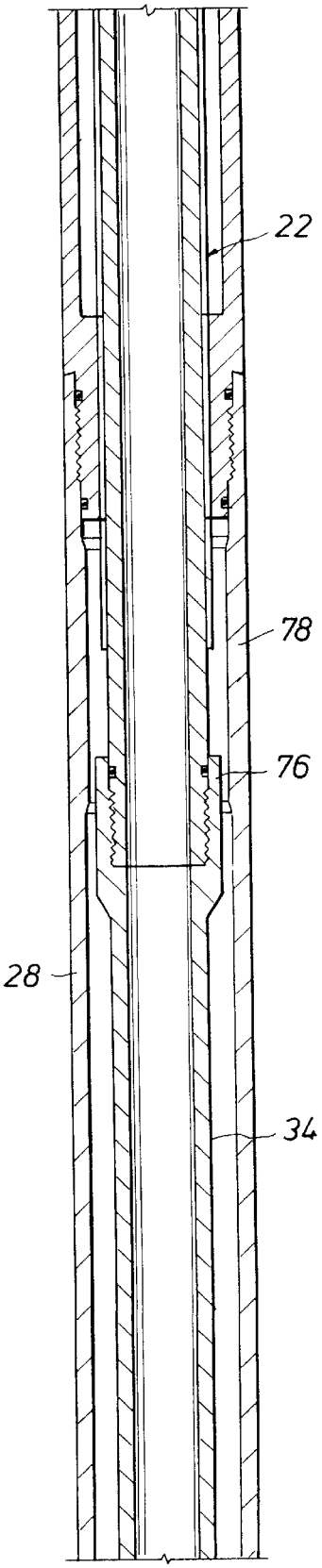
Figure 2C:
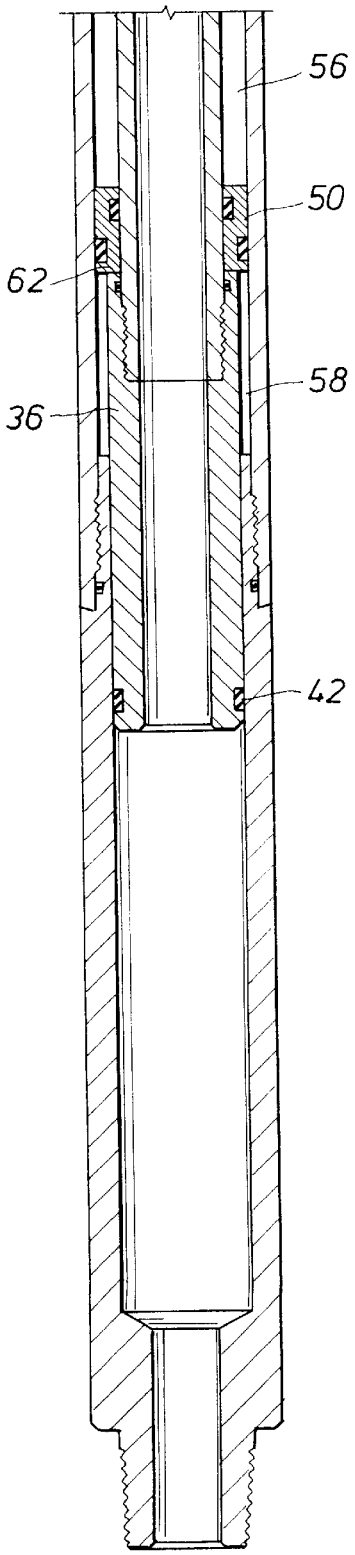
Figure 3A:
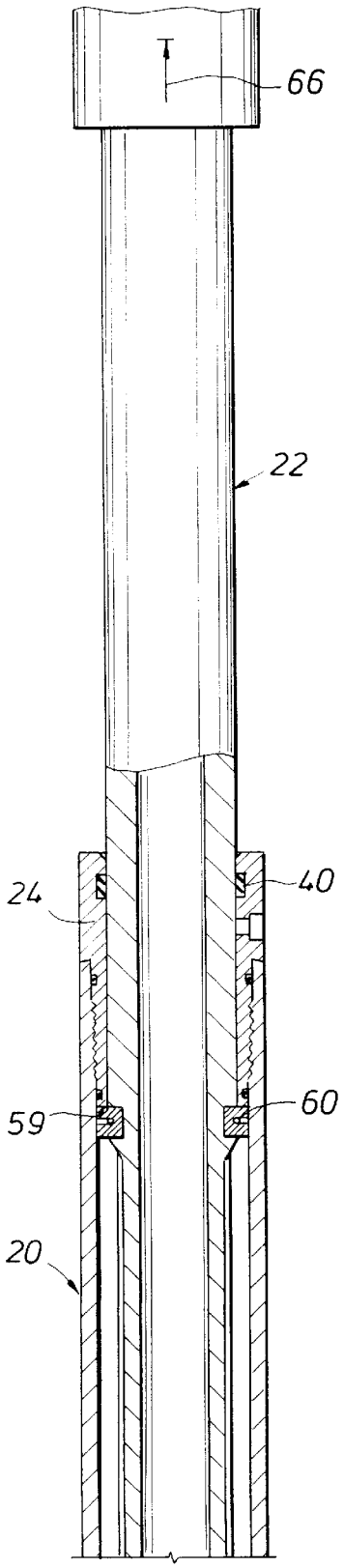
FIGS. 3A–3C are detailed fragmented vertical cross-sectional views of the present invention a substantially fully opened position.
Figure 3B:
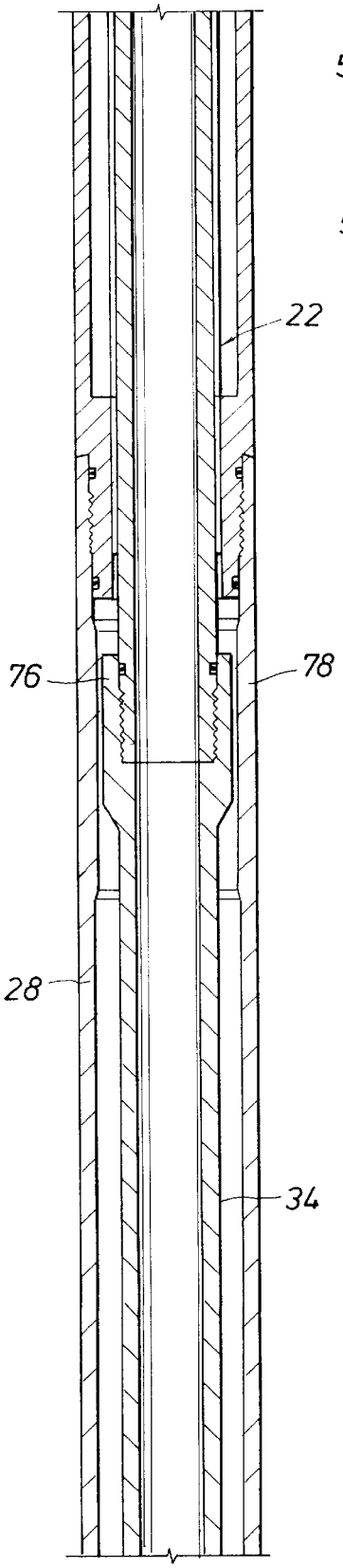
Figure 3C:
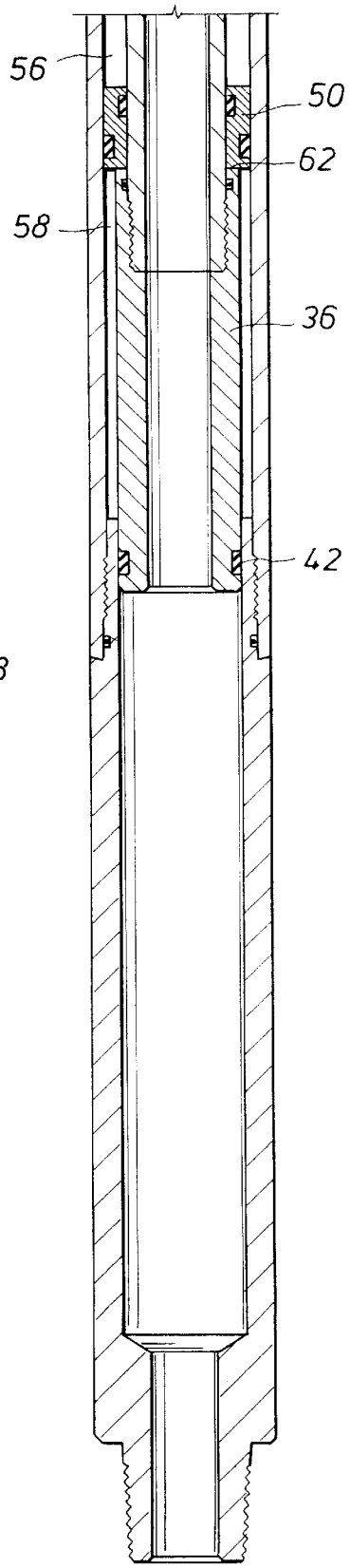

Referring now to FIGS. 1A–1C, 2A–2C and 3A–3C, the operation of the present invention will be described. In particular, the operation of the present invention as it moves from a relatively neutral position as shown in FIGS. 1A–1C to a fully opened position as shown in FIGS. 3A–3C will be described. In the position shown in FIGS. 1A–1C, piston 50 is seated against both the top shoulder 62 of washpipe 36 and the top shoulder 64 of washpipe body 30. At this point, the pressure in chambers 56 and 58 are substantially balanced. As noted above, the present invention is used to provide an enhanced or auxiliary acceleration of the hammer portion of a jarring tool against the anvil portion of the jarring tool. Such a jarring tool must be suitable for coiled tubing application as well and would be typically located in the bottom hole assembly below the present invention. Such a jarring tool suitable for use with the present invention is described and claimed in copending patent application Ser. No. 08/827,794 entitled JARRING TOOL, which patent application is hereby incorporated by reference and made a part hereof.

The movement shown in FIGS. 1A–1C, 2A–2C and 3A–3C of the present invention are movements in an upward direction toward the ground surface, which coincide with an upward jarring action as referred to in the above-identified copending patent application. As noted in the copending patent application and discussed above, a drilling rig operator has a limited compressive load capability when using coiled tubing. Thus, the use of a jarring tool enhancer to accelerate the jarring action of a jarring tool as discussed in the copending application is particularly helpful.

Referring now to FIGS. 2A–2C, the rig operator begins an upward jarring action by introducing a tensile load on the coiled tubing or drill string which advances inner cylindrical assembly 22 in the direction of arrow 66. As inner cylindrical assembly 22 moves upwardly relative to outer cylindrical assembly 20, shoulder 62 of washpipe 36 pushes piston 50 upwardly increasing the volume or size of chamber 58 and reducing, in turn, the volume or size of chamber 56. Since the amount of hydraulic fluid within annular space 38 is limited due to the use of a top seal 40 and the lower seal 42, a pressure differential is created between chambers 56 and 58. In the case of FIG. 2C, in essence a vacuum is created in chamber 58. As the rig operator continues to introduce a tensile load on inner cylindrical assembly 22, a jarring tool such as that disclosed in the above-identified copending patent application would also advance into an upward jarring configuration as shown in FIGS. 8A–8C of the copending patent application. As the rig operator continues to introduce a tensile load in the direction of arrow 66 there would be an increase in the relative longitudinal position between inner cylindrical assembly 22 relative to outer cylindrical assembly 20 as shown in FIGS. 3A–3C.

In this configuration, shoulder 62 of washpipe 36 continues to move piston 50 upwardly increasing the volume of chamber 58 and decreasing the volume of chamber 56 thereby creating a larger pressure differential across piston 50. FIGS. 3A–3C show the fully opened position when ring 60 has seated against the lower shoulder 59 of mandrel body 24.

If a jarring tool is used as that described and claimed in the above-identified copending application, eventually an upward jarring activity would be triggered as that shown in the transition from FIGS. 8A–8C to 9A–9C of the above-identified copending patent application. For example, once the hammer of a jarring tool is released advancing towards an upward jarring position as shown in FIGS. 9A–9C of the above-identified copending patent application, there would be a sudden movement of outer cylindrical assembly 20 relative to inner cylindrical assembly 22 of the present invention. This sudden upward movement releases stored energy within the present invention because of the significant pressure differential between chambers 56 and 58. This sudden release serves to further accelerate the hammer of a jarring tool against the anvil of the jarring tool as described and shown, for example, in FIGS. 9A–9C of the above-identified copending patent application. This energy is eventually dissipated as the pressures between chambers 56 and 58 are balanced which occurs when outer cylindrical assembly 20 moves upwardly relative to inner cylindrical assembly 22 returning the present invention to the neutral position as shown in FIGS. 1A–1C. In the event the rig operator wished to repeat the upward jarring action, he would simply repeat the process referred to above with respect to FIGS. 1A–1C, 2A–2C and 3A–3C. In addition to the upward jarring motion as described above, the present invention is also capable of enhancing a jarring action in a downward mode.

Figure 4A:
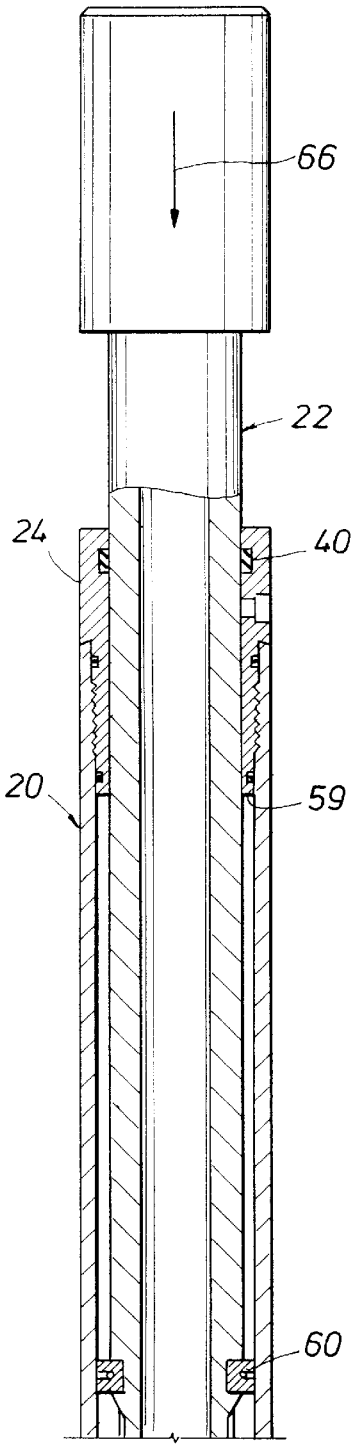
FIGS. 4A–4C are detailed fragmented vertical cross-sectional views of the present invention in a partially closed position.
Figure 4B:
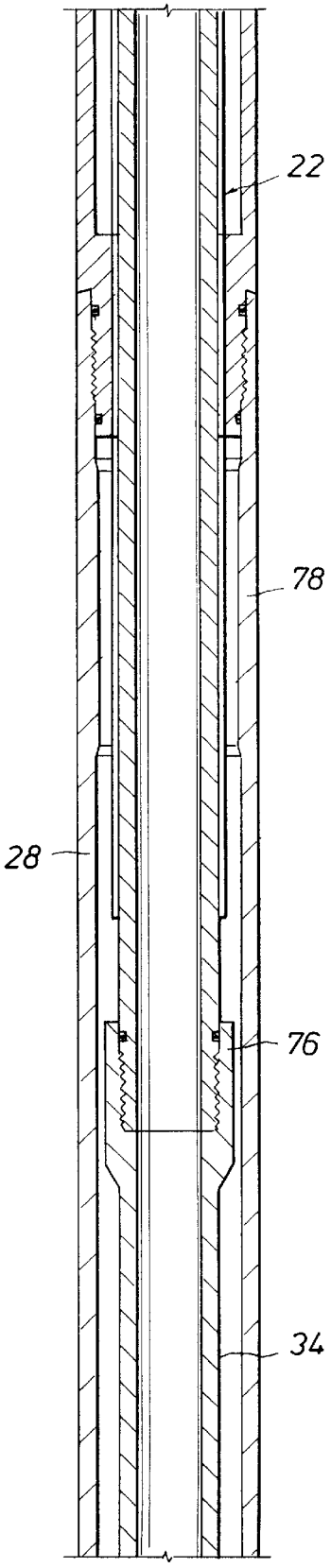
Figure 4C:
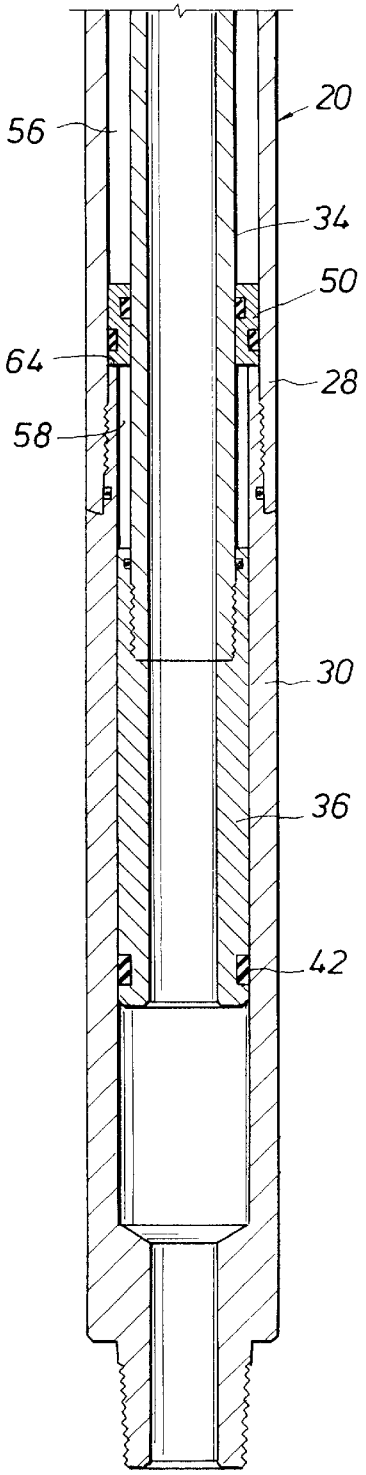
Figure 5A:
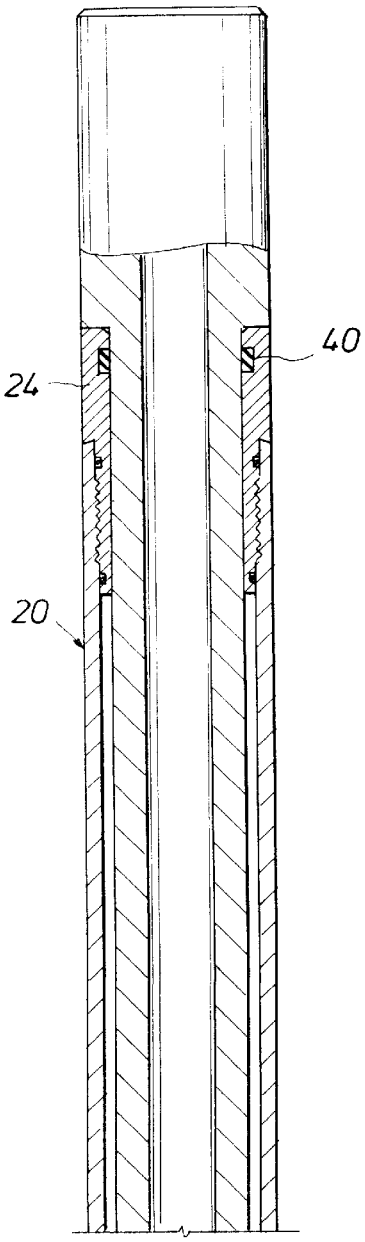
FIGS. 5A–5C are detailed fragmented vertical cross-sectional views of the present invention in a closed position.
Figure 5B:
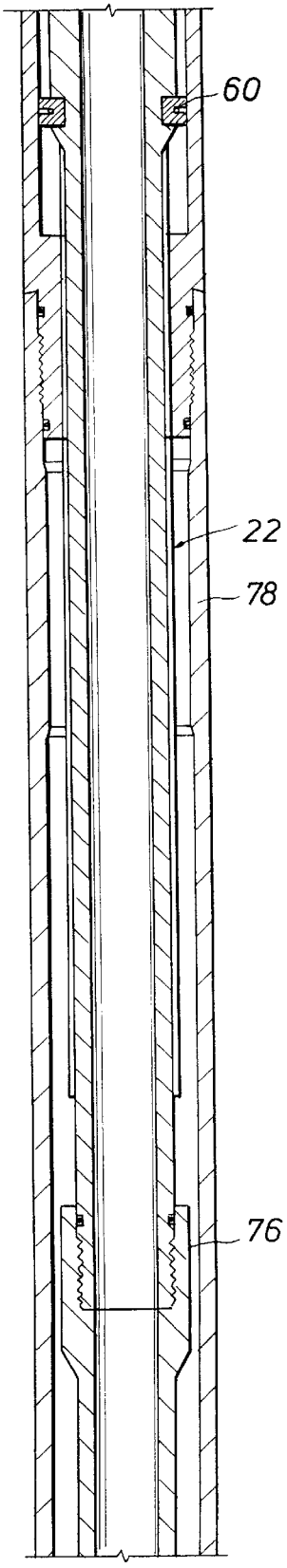
Figure 5C:
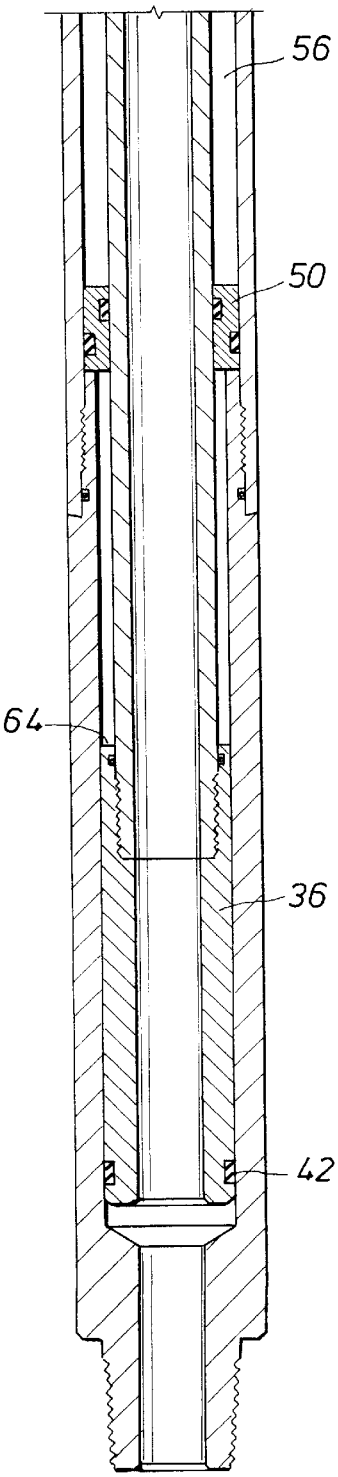

Referring now to FIGS. 4A–4C and 5A–5C, the rig operator begins by introducing a slightly compressive load in the direction of arrow 68 as shown in FIG. 4A. Doing so advances inner cylindrical assembly 22 downwardly relative to outer cylindrical assembly 20. When this occurs, piston 50 is prohibited from moving longitudinally relative to outer cylindrical assembly 20 and in particular middle body 28 and washpipe body 30 because shoulder 64 of washpipe body 36 seats against piston 50 preventing it from moving downwardly as inner cylindrical assembly 22, and in particular mandrel extension 34, moves downwardly. As this occurs, the volume or size of chamber 58 increases and the volume or size of chamber 56 decreases. This in turn results in a pressure differential between chambers 56 and 58 and the creation, once again, of a vacuum in chamber 58 relative to chamber 56. As the operator continues to introduce a compressive load in the direction of arrow 66 as shown in FIG. 4A, the corresponding jarring tool as described and claimed in the above-identified copending application, for example, would enter the operational mode as shown in FIGS. 10A–10C and 11A–11C of that copending application. FIGS. 5A–5C show the final closed position of the present invention as the rig operator continues to exert a downward load in the direction of arrow 68 as shown in FIG. 4A but before the downward jarring action has occurred.

Eventually, as described in the copending application, the jarring tool would initiate a downward jarring activity which, for purposes of the present invention, would result in the sudden movement of outer cylindrical assembly 20 relative to inner cylindrical assembly 22, and in particular, the sudden movement of mandrel extension 34 relative to middle body 28. This sudden movement or release of energy occurs because of the pressure differential between chambers 56 and 58. In this manner, this sudden relative movement between the inner and outer cylindrical assemblies 22/20 serves to accelerate the movement of a hammer towards an anvil of the jarring tool as described and shown in FIGS. 12A–12C of the above-identified copending application for example.

If the rig operator wished to exert another downward jarring action using the present invention, he would repeat the cycle referred to above with respect to FIGS. 4A–4C and 5A–5C as often as he wished to continue to create an enhanced or accelerated effect to the hammer and anvil of the jarring tool.

It will be apparent to one skilled in the art that it is not necessary for the rig operator to take the present invention to the fully opened or fully closed positions as shown in FIGS. 3A–3C or FIGS. 5A–5C, respectively. Rather, the present invention may serve as an enhancer without the need to be fully opened or fully closed. As described above, precisely when the energy stored within the enhancer and the drill string would be released would be determined by the tripping of the jar tool as described in the copending application, for example.

It will also be understood by one skilled in the art that the present invention is not limited to an operation in the orientation as shown in FIGS. 1A–1C. Obviously, the present invention may be turned upside down and it will still perform equally well. To that extent, the terms "upward" and "downward" as used herein are with reference to the orientation shown in FIGS. 1A–1C, for example.

Additionally, it will be apparent to one skilled in the art based on this disclosure that the description and claiming of the present invention in terms of permitting rapid acceleration of outer cylindrical assembly 20 relative to inner cylindrical assembly 22 also means rapid acceleration of inner cylindrical assembly 22 relative to outer cylindrical assembly 20. These operational terms are deemed to be equivalent for purposes of the present invention and the claims as attached hereto.

The present invention also provides an enhanced safety feature in the event a threaded joint of either the inner or outer cylindrical assemblies separate. This may occur due to significant pressure increases, material fatigue or excessive loading, for example.

Referring back to FIGS. 1A–1C, the key joints of concern from a safety standpoint are threaded connection 71 between mandrel body 24 and spline body 26, threaded connection 72 between spline body 26 and middle body 28, and threaded connection 73 between mandrel 32 and mandrel extension 34.

In the event the rig operator is exerting an upward tensile load 66 as shown in FIG. 3A or a downward compressive load 68 as shown in FIG. 4A and threaded connection 71 fails, box connection 76 of mandrel extension 34 will advance upwardly with reference to FIG. 1B forcibly engaging splines 48 in region "A" of spline body 26. This forcible engagement would prevent further displacement of inner cylindrical assembly 22 relative to outer cylindrical assembly 20 thereby preventing loss of the lower part of the coiled tubing, drill pipe or tool downhole or other catastrophic event. This safety feature occurs whether a compressive or tensile load is being applied to the mandrel 32 by the rig operator.

Furthermore, in the event threaded section 72 separates, the present invention provides that piston 50 would advance upwardly rapidly relative to outer cylindrical assembly 20 until it forceably engages the thickened upset wall portion of middle body 28 as shown by region "B" of FIG. 1B. This thickened wall portion (region "B") of middle body 28 is thin enough to permit passage of splines 46 when operating in a normal mode, but gradually increases in thickness from the lower to the upper end to stop the advancement of piston 50 in the event of a catastrophic failure of thread 72. In this manner, once again loss of the lower part of the coiled tubing, drill pipe, downhole tool or portion of the bottom hole assembly would be prevented whether the failure occurred when the rig operator was applying a tensile or compressive load.

Finally, in the event of a catastrophic failure of threads 73, the present invention prevents the loss of outer cylindrical assembly 20 and the rest of the bottom hole assembly because mandrel retainer ring 60 would advance upwardly towards mandrel body 24 forceably engaging mandrel body 24 and thereby forceably interlocking with it. Once again this will occur whether the rig operator is applying a tensile or compressive load.

Accordingly, the present invention provides a jarring tool enhancer of limited lengths due to the use of a single annular chamber 38 which can be divided into upper and lower chambers 56/58 depending on whether the operator introduces a compressive or tensile load. The present invention also uses a single piston within that single annular chamber further reducing the overall length of the present invention. This simplified design has significant advantages because of its limited length, particularly in coiled tubing application. Yet it still performs as a jarring tool enhancer providing a significant increase in the jarring load on the stuck tool through its rapid acceleration of the inner cylindrical assembly 22 relative to the outer cylindrical assembly 20.

The foregoing invention has been described in terms of various embodiments. Modifications and alterations to these embodiments will be apparent to those skilled in the art in view of this disclosure. It is, therefore, intended that all such equivalent modifications and variations fall within the spirit and scope of the present invention as claimed below.

What is claimed is:

1. A well jar enhancer comprising:

inner and outer telescopingly related cylindrical assemblies movable longitudinally relative to one another in first and second directions, said inner and outer cylindrical assemblies having telescopingly overlapping portions providing an annular space therebetween having an upper end and a lower end, each said inner and outer cylindrical assemblies having first and second ends;

first means for sealing the upper end of said annular space;

second means for sealing the lower end of said annular space;

a single piston in said annular space sealing against fluid passage in said annular space through said piston and adapted to be longitudinally displaced within said annular space;

said inner cylindrical assembly having means to contact said piston as said inner cylindrical assembly moves relative to said outer cylindrical assembly in said first direction for compressing fluid in a first chamber between said first sealing means and said piston; and said outer assembly having means to prohibit longitudinal movement of said piston within said annular space beyond a predetermined point when said inner cylindrical member moves relative to said outer cylindrical member in said second direction to compress the fluid in said first chamber between said first sealing means and said piston so as to permit acceleration of said outer cylindrical assembly in each said first and second directions.

2. The well jar enhancer according to claim 1 wherein said first end of said inner cylindrical assembly includes a threaded connection and said second end of said outer cylindrical assembly includes a threaded connection enabling the engagement of said inner and outer cylindrical assemblies with other tubular members.

3. The well jar enhancer according to claim 1 wherein said inner and outer cylindrical assemblies include means for enabling rotational transfer from one of said cylindrical assemblies to the other of said cylindrical assemblies.

4. The well jar enhancer according to claim 3 wherein said enabling means comprises engageable spline members provided on said inner and outer cylindrical assemblies.

5. The well jar enhancer according to claim 1 wherein said piston comprises an annular ring having an internal seal adapted to sealably contact said inner cylindrical assembly and an external seal adapted to sealably contact said outer cylindrical assembly.

6. A well jar enhancer comprising:

inner and outer telescopingly related cylindrical assemblies movable longitudinally relative to one another and telescopingly overlapping portions providing an annular space therebetween having an upper end and a lower end;

first seal means for sealing the upper end of said annular space;

second seal means for sealing the lower end of said annular space;

a sealing piston adapted to be longitudinally displaced within said annular space;

said inner cylindrical assembly having means to contact said piston and advance said piston in a first direction within said annular space defining a first chamber between said first sealing means and said piston and a second chamber between said second sealing means and said piston;

said outer cylindrical assembly having means to prohibit longitudinal movement of said piston in said annular space in a second direction, opposite said first direction, beyond a predetermined point relative to said outer cylindrical assembly so as to also define said first and second chambers; and means for creating a pressure between said piston and said first seal means upon advancement of said piston in said first or second direction permitting acceleration of said outer cylindrical assembly relative to said inner cylindrical assembly in each said first or second directions.

7. A well jar enhancer comprising:

inner and outer telescopingly related cylindrical assemblies movable longitudinally relative to one another and having telescopingly overlapping portions providing an annular space therebetween, said inner and outer cylindrical assemblies having first and second ends;

first seal means for sealing one end of said annular space;

second seal means for sealing the other end of said annular space;

a sealing piston adapted to be longitudinally displaced within said annular space;

said inner cylindrical assembly having means to contact said piston and advance said piston in a first direction within said annular space defining a first chamber between said first sealing means and said piston and a second chamber between said second sealing means and said piston;

said outer cylindrical assembly having means to prohibit the longitudinal movement of said piston in said annular space in a second direction, opposite said first direction, beyond a predetermined point relative to said outer cylindrical assembly to compress the fluid in said annular space between said piston and said first seal means when said inner cylindrical assembly is moved in either longitudinal direction relative to said outer cylindrical assembly; and wherein advancement of said piston in said first or second direction creates a pressure differential permitting acceleration of said outer cylindrical assembly relative to said inner cylindrical assembly in each first or second directions.

8. A well jar enhancer comprising:

inner and outer telescopingly related cylindrical assemblies movable longitudinally relative to one another in first and second directions, said inner and outer cylindrical assemblies having telescopingly overlapping portions providing an annular space therebetween having an upper end and a lower end, each said inner and outer cylindrical assemblies having first and second ends;

a sealing piston adapted to be longitudinally displaced within said annular space;

said inner cylindrical assembly having means to contact said piston as said inner cylindrical assembly moves relative to said outer cylindrical assembly in an upward direction to compress the fluid above said piston for creating a potential upward acceleration; and said outer assembly having means to prohibit longitudinal movement of said piston downwardly within said annular space beyond a predetermined point when said inner cylindrical assembly moves downwardly relative to said outer cylindrical member to compress the fluid above said piston for creating a potential downward acceleration; and wherein telescoping movement of said inner cylindrical assembly relative to said outer cylindrical assembly in said upward direction displaces said piston upwardly relative to said outer cylindrical assembly and telescoping movement of said inner cylindrical assembly downwardly relative to said outer cylindrical assembly displaces said piston upwardly relative to said inner cylindrical assembly, creating a pressure differential between said first and second chambers when said piston moves relative to either said inner or outer cylindrical assembly so as to permit acceleration of said outer cylindrical assembly relative to said inner cylindrical assembly to balance the pressures in said first and second chambers when said inner cylindrical assembly moves relative to said outer cylindrical assembly in each said first and second directions.

* * * * *